US006574822B1

(12) United States Patent
Osiecki et al.

(10) Patent No.: US 6,574,822 B1
(45) Date of Patent: Jun. 10, 2003

(54) HAND-HELD SCRUB BRUSH WITH INTEGRATED DETAILING BRUSH

(75) Inventors: Scott Osiecki, Skaneateles, NY (US); Steve Sieckowski, Camillus, NY (US)

(73) Assignee: SBI, Incorporated, St. Louis, MO (US)

( * ) Notice: Subject to any disclaimer, the term of this patent is extended or adjusted under 35 U.S.C. 154(b) by 115 days.

(21) Appl. No.: 09/664,581

(22) Filed: Sep. 18, 2000

(51) Int. Cl.[7] ..... A47L 13/12
(52) U.S. Cl. ..... 15/106; 15/160
(58) Field of Search ..... 15/106, 160, 159.1

(56) References Cited

U.S. PATENT DOCUMENTS

| | | | | |
|---|---|---|---|---|
| 817,117 | A | * | 4/1906 | Isaacs |
| 2,991,494 | A | | 7/1961 | Smith |
| 4,023,677 | A | | 5/1977 | Wittner et al. |
| 5,491,863 | A | | 2/1996 | Dunn |
| D388,617 | S | | 1/1998 | Ancona et al. |
| D410,147 | S | | 5/1999 | King et al. |
| D435,970 | S | | 1/2001 | Osiecki et al. |

OTHER PUBLICATIONS

EKCO Cleaning Brush.

* cited by examiner

*Primary Examiner*—Randall E. Chin
(74) *Attorney, Agent, or Firm*—Thompson Coburn LLP

(57) ABSTRACT

A dual brush assembly has a detail brush that is removably attached to a scrub brush. The scrub brush has a footing to which a bristle block is attached. The bristle block includes a plurality of brush bristles that form a substantially flat bristle surface and a curved bristle surface. The detail brush has a brush head with a plurality of bristles forming a smaller surface area than the curved bristle surface and forming a substantially smaller surface area than the flat bristle surface. The detail brush conformably fits into a recess in a grip of the scrub brush, and the recess has a sloped surface to receive the brush head. The detail brush also has a pressure pad that flares out to cover the brush head. In the attached position, the pressure pad substantially covers the recess and provides a ridge for detaching the detail brush from the scrub brush. In the detached position, the pressure pad provides a platform for a user's thumb or forefinger.

16 Claims, 2 Drawing Sheets

HAND-HELD SCRUB BRUSH WITH INTEGRATED DETAILING BRUSH

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

This invention relates generally to cleaning devices and, more particularly, to a dual brush assembly in which a detail brush conformably fits along a grip of a scrub brush.

2. Description of Related Art

It is generally known to removably attach a cleaning brush to the handle of a scrub brush such that the bristles of both brushes are exposed, as in U.S. Pat. No. 2,991,494. It is also known to attach a small brush to a large brush such that the bristles of a small brush are inserted into a cavity in the large brush, thereby protecting the bristles of the small brush. For example, U.S. Pat. No. 4,023,677 ("the '677 Patent") teaches a guide groove opening for sliding a small brush into the housing of a large brush, and U.S. Pat. No. 5,491,863 ("the '863 Patent") teaches a small brush that fits into a recess in a large brush.

Generally, for brushes that have bristles of the small brush inserted into the cavity of the large brush, the direction of insertion is substantially perpendicular to the orientation of the bristles on the small brush. In these nested brushes, as the small brush is inserted into the cavity of the large brush, the bristles can bend slightly as they enter the cavity and snap back into place as they pass entrance to the cavity. The shape of the small brush and the respective cavities in the '677 Patent and the '863 Patent actually prevent the small brush from being inserted in any manner other than perpendicular to the orientation of the bristles.

More recently, some of these dual brushes now provide cavities in which the small brush can be inserted directly in line with the orientation of the bristles and are no longer limited to the perpendicular insertion. For example, a cleaning brush sold under the EKCO trademark provides a cavity along the entire length of the brush handle in which a small brush conformably fits. The cavity is also open in the front of the EKCO cleaning brush, permitting the small brush to be inserted in the traditional manner, perpendicular to the orientation of the bristles, and it is also possible to insert the small brush directly in line with the orientation of the bristles. When inserting the small brush in line with the bristles, it is critical for the user to carefully align the bristles with the cavity because if the bristles are not in the precise alignment with the cavity, some bristles will get caught on the edge of the cavity and will be bent out of shape.

Additionally, all of these dual brushes have a substantially flat bristle surface. The flat bristle surface of the large brush is well suited to clean the face of surfaces while the bristles of the small brush are well suited to clean crevices. However, the large, flat surface is not effective for cleaning large, contoured surfaces with tight curves and the small brush is inefficient for cleaning such a large surface.

The nested brushes necessarily have small brushes with bristles that are more narrow than the cavity, regardless of whether the small brush has an elongated handle or a stubby handle. The small brushes with an elongated handle also have a narrow head in which the bristles are attached. However, the stability and leverage of a small brush is reduced when an elongated handle is combined with a narrow head.

BRIEF SUMMARY OF THE INVENTION

It is in view of the above problems that the present invention was developed. Among the objects and features of the present invention is a detail brush that can be more easily inserted into a scrub brush without precisely aligning bristles of the detail brush the scrub brush opening.

A second object of the present invention is to provide a dual brush that can more effectively and efficiently clean flat surfaces, curved surfaces, and crevices.

A third object of the present invention is to provide a nested brush with improved stability and leverage.

In one aspect of the present invention, a dual brush assembly has a detail brush that is removably attached to a scrub brush. The detail brush, including a brush head with a plurality of bristles, conformably fits into a recess in a grip of the scrub brush. The recess has a sloped surface to receive the plurality of bristles in the brush head.

In a second aspect of the present invention, a dual brush assembly has a detail brush that is removably attached to a scrub brush. The scrub brush has a footing to which a bristle block is attached. The bristle block includes a plurality of brush bristles that form a substantially flat bristle surface and a curved bristle surface. The detail brush has a brush head with a plurality of bristles forming a smaller surface area than the curved bristle surface and forming a substantially smaller surface area than the flat bristle surface.

In a third aspect of the present invention, a dual brush assembly has a detail brush that is removably attached to a scrub brush. The detail brush has a handle and a brush head, and a pressure pad flares out from the handle and covers the brush head. The scrub brush has a recess for receiving the brush head. In the attached position, the pressure pad substantially covers the recess and provides a ridge for detaching the detail brush from the scrub brush. In the detached position, the pressure pad provides a platform for a user's thumb or forefinger.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION OF THE INVENTION

Figure 1:
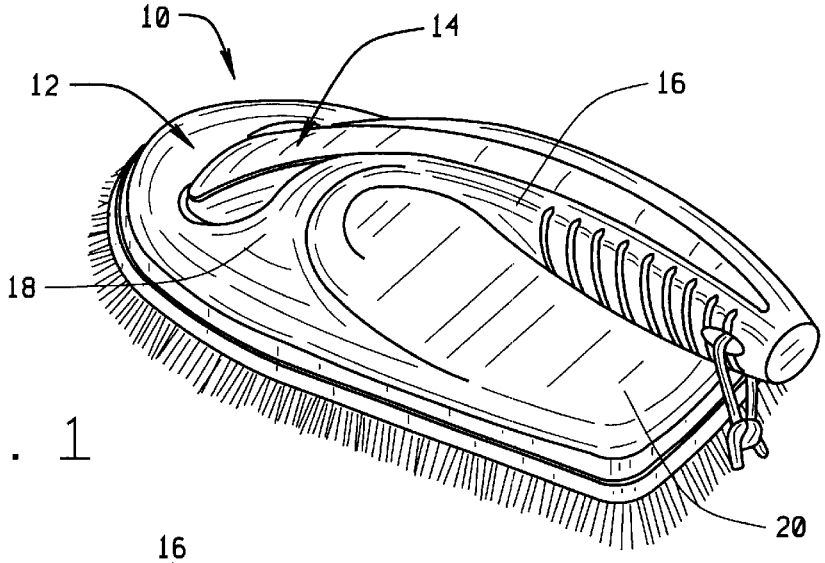
FIG. 1 illustrates a perspective view of a dual brush assembly according to a preferred embodiment of the present invention.
Figure 2:
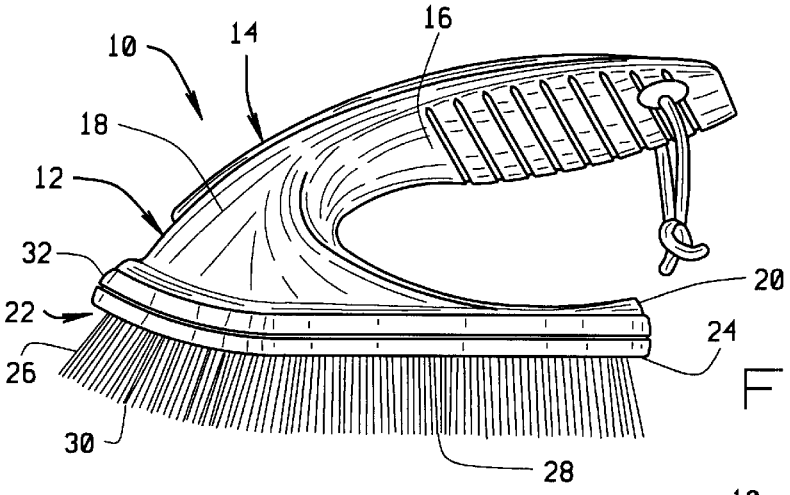
FIG. 2 illustrates a side elevation view of the dual brush assembly in FIG. 1.
Figure 3:
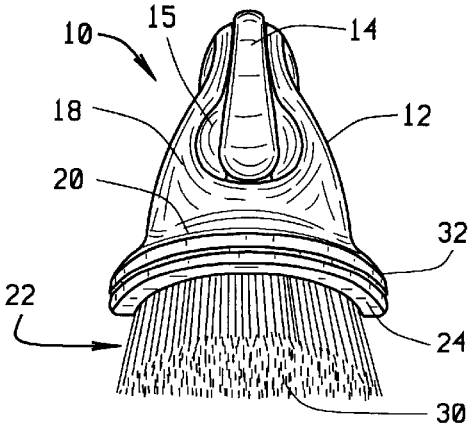
FIG. 3 illustrates a front elevation view of the dual brush assembly in FIG. 1.
Figure 4:
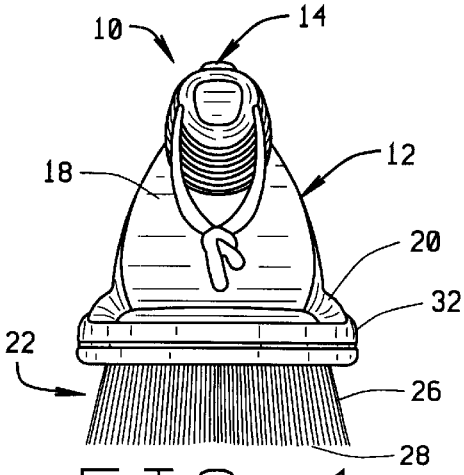
FIG. 4 illustrates a back elevation view of the dual brush assembly in FIG. 1.

Referring to the accompanying drawings, in which like reference numbers indicate like elements, FIGS. 1–4 illustrate a dual brush assembly 10 that has a scrub brush 12 and a detail brush 14 which fits into an opening 15 in a grip 16 of the scrub brush 12. The grip has a shank 18, and a base plate 20 is attached to the shank. The base plate 20, preferably formed with the shank as an integral unit, attaches to a bristle block 22. A footing 24 of the bristle block 22 holds a plurality of brush bristles 26. The brush bristles 26 are preferably arranged in the footing 24 to form a substantially flat bristle surface 28 and a curved bristle surface 30. The footing 24 may also be surrounded by a bumper 32.

Figure 5:
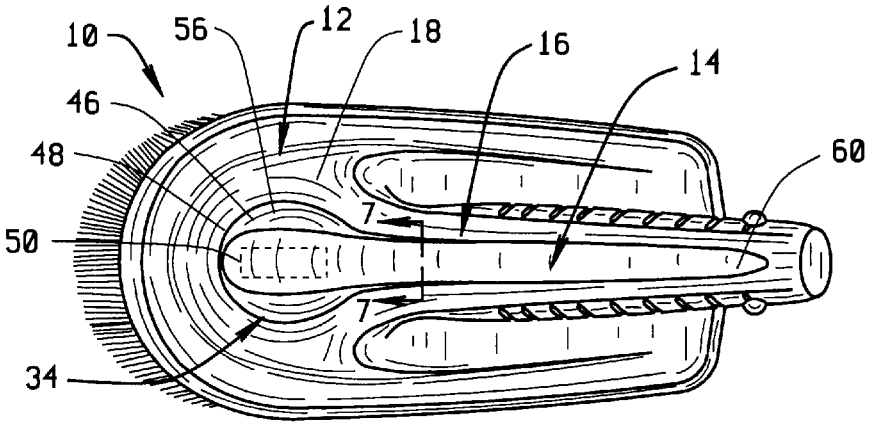
FIG. 5 illustrates a top plan view of the dual brush assembly in FIG. 1.
Figure 6:
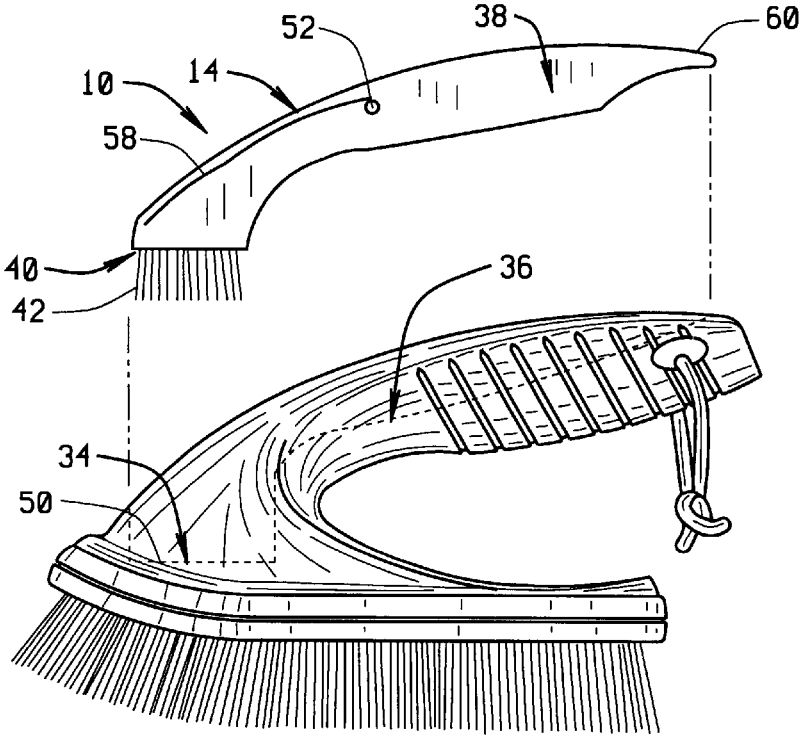
FIG. 6 illustrates an exploded side elevation view of the dual brush assembly in FIG. 1.
Figure 7:
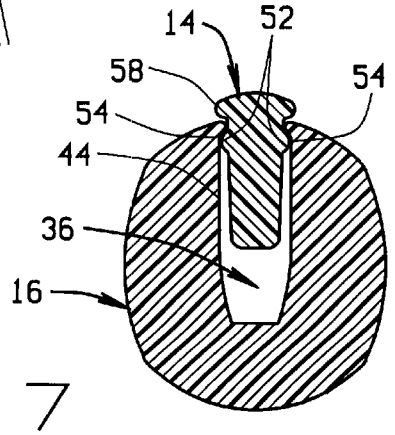
FIG. 7 illustrates a cross-sectional view of the dual brush assembly along line 7-7 in FIG. 5.

Referring specifically to FIGS. 5–7, particular features of the dual brush's 10 scrub brush 12 and detail brush 14 are described. The opening 15 in the grip 16 is formed by a recess 34 in the shank 18 and a groove 36 extending from the recess 34 along a substantial length of the of the grip 16. Preferably, the recess 34 and groove 36 are integrally formed with the grip 16. The detail brush 14 has a handle 38 that conformably fits into the groove 36 and a brush head 40, including a plurality of bristles 42, that fits into the recess 34. The groove 36 has walls 44 that conform with the handle 38 and are substantially vertical, whereas the recess 34 preferably has a sloped surface 46 to prevent the brush head bristles 42 from bending on a sharp corner. The sloped surface 46 permits the detail brush 14 to be easily inserted into the scrub brush 12 with only gross alignment between the detail brush and the scrub brush.

The recess 34 preferably has an outer rim 48 with a rounded shape that is wider than the groove 36 and a bottom surface 50 with a substantially rectangular shape. The sloped surface 46 transitions from the rounded shape at the outer rim 48, where the sloped surface is generally concave, to the substantially rectangular shape at the bottom surface 50, where the sloped surface is substantially vertical. It should be recognized that the outer rim 48 may be other shapes without departing from the present invention, and the recess 34 and groove 36 could be cut out or machined from a solid grip blank (not shown) rather than integrally forming the sloped recess 34.

The detail brush 14 is removably attached to the scrub brush 12. As the detail brush 14 is fit into the scrub brush 12, the sloped surface 46 directs the bristles 42 into the recess 34, making it less likely that the bristles will be bent out of shape. When the detail brush 14 is fully fit into the scrub brush 12, the bristles 42 are constrained in their patterned shape by the substantially vertical walls along the bottom surface 50 and the handle 38 is snap-fit in place. Preferably, the snap-fit has a pair of dimples 52 on the handle 38 that fit into a respective pair of indentations 54 formed in the groove 36. Removable attachment between the detail brush 14 and the scrub brush 12 can alternatively be achieved with dimples on the groove 36 and indentations in the handle 38.

The detail brush 14 preferably has a pressure pad 56 flaring out from the handle 38 over the brush head 40. The pressure pad 56 offers several useful advantages. When using the detail brush 14 apart from the scrub brush 12, the pressure pad 56 is where a user would push down with a thumb or forefinger (not shown). In this detached position, the pressure pad 56 provides a platform for a user's thumb or forefinger that is wider than the brush head 40, improving stability and leverage. When using the scrub brush 12 with the detail brush 14 in place, the pressure pad 56 would similarly support a user's thumb or forefinger by covering a substantial portion of the recess 34. In this attached position, the overall stability and leverage of the dual brush assembly 10 is retained by the pressure pad 56. In both the attached and detached positions, the wider surface better supports the user's thumb or forefinger and is more comfortable for the user. Additionally, by flaring out from the handle 38, the pressure pad 56 forms a ridge 58 that provides leverage for separating the detail brush 14 from the scrub brush 12. At the other end of the detail brush 14, opposite the brush head 40, the handle has a pick 60. The pick 60 can be useful for digging out grime in a crevice (not shown) or for popping off a hub cap (not shown).

Although the base plate 20 can be integrally formed with the shank 18 through injection molding process, it is anticipated that the base plate could be formed apart from the shank and the parts could be attached according to other well known techniques, including gluing (epoxies generally), welding, snap-fitting, and using hardware such as rivets, screws, and bolts. Any one of these well known connections, including a snap-fit connection, may be similarly used to attach the footing 24 to the base plate 20 without departing from the invention.

The substantially flat bristle surface 28 is well suited to clean the face of surfaces such as countertops, bathtubs, walls, floors, wheels, and vehicle panels (not shown). The detail brush's bristles 42 cover a substantially smaller surface area than the flat bristle surface 28 and the brush head 40 is well suited to clean the crevices between surfaces such as the grout between tiles, the silicon between countertop sections, and the grooves in wheel hubs. The curved bristle surface 30 is larger than the detail brush's brush head 40, but it is not as large as the flat bristle surface 28. The intermediate size of the curved bristle surface 30 allows the user to concentrate the action of the scrub brush 12 in a particular area without removing the detail brush 14. The curvature may also be beneficial for scrubbing highly curved surfaces that have too much surface area to employ the detail brush 14. As one example, plastic stacking chairs have highly curved seats and legs, and the combination of a flat bristle surface 28 with a curved bristle surface 30 is more effective than using a flat bristle surface alone and is more efficient than using a detail brush 14.

In view of the foregoing, it will be seen that the several advantages of the invention are achieved and attained. The preferred embodiment and alternatives were chosen and described in order to best explain the principles of the invention and its practical application to thereby enable others skilled in the art to best utilize the invention in various embodiments and with various modifications as are suited to the particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting. For example, although the scrub brush's bristles 26 are preferably arranged to form a flat bristle surface 28 and a curved bristle surface 30, it should be recognized that the present invention anticipates that the bristles 26 may be arranged to form a flat bristle surface without any curvature. Thus, the breadth and scope of the present invention should not be limited by any of the above-described exemplary embodiments, but should be defined only in accordance with the following claims appended hereto and their equivalents.

What is claimed is:

1. A dual brush for cleaning surfaces and crevices therebetween, comprising:

(a) a scrub brush having a grip, the grip having shank with a recess and having a groove extending from the recess along the grip, a base plate attached to the shank, and a bristle block attached to the base plate the bristle block comprising a footing holding a plurality of brush bristles, a substantially flat bristle surface, and a curved bristle surface; and (b) a detail brush removably attached to the scrub brush and having a handle that fits into the groove of the scrub brush, a brush head that conformably fits into the recess of the scrub brush, and a pressure pad flaring out from the handle over the brush head.

2. A dual brush according to claim 1, wherein the recess of the scrub brush has a sloped surface.

3. A dual brush according to claim 2, wherein the recess of the scrub brush further comprises:

an outer rim with a rounded shape;

a bottom surface with a substantially rectangular shape; and wherein the sloped surface transitions from the rounded shape to the substantially rectangular shape.

4. A dual brush for cleaning surfaces and crevices therebetween, comprising:

(a) a scrub brush having a grip, the grip having a shank with a recess and having a groove extending from the recess along the grip, a base plate attached to the shank, and a bristle block attached to the base plate, the bristle block having a footing holding a plurality of brush bristles, a substantially flat bristle surface, and a curved bristle surface; and (b) a detail brush removably attached to the scrub brush and having a handle that conformably fits into the groove of the scrub brush and a brush head that fits into the recess of the scrub brush, the detail brush having a pressure pad flaring out from the handle over the brush head.

5. A dual brush according to claim 4, wherein the recess of the scrub brush has a sloped surface.

6. A dual brush according to claim 5, wherein the recess further comprises:

an outer rim with a rounded shape;

a bottom surface with a substantially rectangular shape; and wherein the sloped surface transitions from the rounded shape to the substantially rectangular shape.

7. A dual brush according to claim 4, wherein the curved bristle surface is larger than the brush head of the detail brush and smaller than the flat bristle surface.

8. A dual brush according to claim 4, wherein a snap-fit connection is used to attach the bristle block to the base plate.

9. A dual brush according to claim 4, further comprising a bumper surrounding the footing.

10. A dual brush for cleaning surfaces and crevices therebetween, comprising:

(a) a scrub brush having a grip, the grip having a shank with a sloped recess and having a groove extending from the sloped recess along a portion of the grip, the sloped recess comprising an outer rim with a rounded shape, a bottom surface with a substantially rectangular shape, and a sloped surface that transitions from the rounded shape at the outer rim to the substantially rectangular shape at the bottom surface, a base plate attached to the shank, and a bristle block attached to the base plate; and (b) a detail brush removably attached to the scrub brush, the detail brush having a handle that conformably fits into the groove of the scrub brush and having a brush head that fits into the sloped recess of the scrub brush.

11. A dual brush according to claim 10, wherein the detail brush has a pressure pad flaring out from the handle over the brush head.

12. A dual brush according to claim 10, wherein the bristle block comprises:

a footing holding a plurality of brush bristles;

a substantially flat bristle surface; and a curved bristle surface.

13. A dual brush according to claim 10, wherein the handle has an end with a pick.

14. A dual brush according to claim 10, wherein the base plate is integrally formed with the shank.

15. A dual brush according to claim 10, wherein a snap-fit removably attaches the detail brush to the grip.

16. A dual brush according to claim 15, wherein the snap-fit is comprised of a pair of dimples that fit into a respective pair of indentations.

* * * * *